US005386877A

United States Patent [19]

Codina et al.

[11] Patent Number: 5,386,877

[45] Date of Patent: Feb. 7, 1995

[54] HIGH VOLTAGE RIPPING APPARATUS

[75] Inventors: George G. Codina, Van Nuys, Calif.; Robert J. Price, Dunlap, Ill.; Liliana Grajales, Blacksburg, Va.; Thomas J. Richards, Peoria, Ill.

[73] Assignee: Caterpillar Inc., Peoria, Ill.

[21] Appl. No.: 829,028

[22] PCT Filed: Dec. 2, 1991

[86] PCT No.: PCT/US91/0884

§ 371 Date: Dec. 2, 1991

§ 102(e) Date: Dec. 2, 1991

[87] PCT Pub. No.: WO93/11309

PCT Pub. Date: Jun. 10, 1993

[51] Int. Cl.[6] ..... A01B 13/08

[52] U.S. Cl. ..... 172/699

[58] Field of Search ..... 172/699, 700, 6, 5, 172/2; 175/16; 299/14

[56] References Cited

U.S. PATENT DOCUMENTS

| | | | |
|---|---|---|---|
| 3,713,496 | 1/1973 | Codlin | 172/699 |
| 3,820,847 | 6/1974 | Jacoby | 299/14 X |
| 3,887,237 | 6/1975 | Bailey et al. | 299/14 X |
| 4,113,315 | 9/1978 | Melton, Jr. et al. | 299/14 X |
| 4,204,578 | 5/1980 | Stedman | 172/699 X |
| 4,540,127 | 9/1985 | Andres | 241/1 |
| 4,653,697 | 3/1987 | Codina | 241/1 |
| 4,667,738 | 5/1987 | Codina | 166/248 |
| 4,741,405 | 5/1988 | Moeny et al. | 175/16 |
| 4,802,787 | 2/1989 | Bays | 172/5 X |
| 4,850,434 | 7/1989 | Rubemeyer et al. | 172/699 X |
| 4,984,850 | 1/1991 | Jensen | 299/37 |
| 5,106,164 | 4/1992 | Kitzinger et al. | 175/16 X |

FOREIGN PATENT DOCUMENTS 1018934 2/1966 United Kingdom .

OTHER PUBLICATIONS

Powder Technology, 1986, pp. 269–277, "Liberation of Mineral Constituents by High-Voltage Pulses" by Dr. U. Andres and R. Bialecki.

Engineering and Mining Journal, 166, 1965, pp. 97–98, "Penn State meeting gives last word on drilling-blasting tools and methods".

Mining & Minerals Engineering, 1967, p. 10, "Some recent development trends for surface mining" by R. K. Singhal.

Mining Congress Journal, 1961, pp. 53–55, "Dustless Breaking of Rocks Electrically" by V. S. Kravchenko, A. P. Obrastsov and V. V. Ustinov, M. E.

*Primary Examiner*—Randolph A. Reese
*Assistant Examiner*—Christopher J. Novosad
*Attorney, Agent, or Firm*—James R. Yee

[57] ABSTRACT

An apparatus (102) assists an earthmoving vehicle (104) in the fracture of material (106). The apparatus (102) includes a ripping structure (108) having at least one ripper (112) and one electrode (130). The apparatus (102) generates electrical energy and discharges the electrical energy into the material through the ripping structure (108).

52 Claims, 9 Drawing Sheets

HIGH VOLTAGE RIPPING APPARATUS

TECHNICAL FIELD

This invention relates generally to rippers for earthmoving equipment, and more particularly to a ripper using high voltage pulsed current to assist in the fracture of rock.

BACKGROUND ART

The need for efficient, cost effective, and reliable rock fracturing has gained priority, especially in mining operations. Typically, when a large rock or other especially hard material is found, conventional drill and blast methods using chemical explosives are used. These methods are not only potentially dangerous, but also time consuming.

Some earthmoving equipment, such as track type tractors come equipped with rippers. With conventional tractor/ripper arrangements, an operator will make at least two passes with the vehicle over the same ground area. During the first pass, the operator will engage the ripping apparatus. This is normally accomplished through actuation of a control lever within the operator's cab. As the ripper is pulled through the material, the material is fractured or broken up. This is an inefficient process, as most of the work is being done through the tip of the ripper. Consequently, the tip wears out at a fast rate and has to be replaced often. Furthermore, some material cannot be fractured or fragmented using conventional rippers.

One proposed solution is to use high voltage pulses through a pair of electrodes to fracture material. Most of these methods require that two electrodes be buried into the material to be fractured at a suitable depth. This frequency requires an additional drilling step to achieve that depth. Other pulsing methods require that the material to be fractured and the electrodes be immersed in water or other liquid.

The subject invention is directed at overcoming one or more of the problems as set forth above.

DISCLOSURE OF THE INVENTION

In one aspect of the present invention, an apparatus to assist an earthmoving vehicle in the fracture of material is provided. The apparatus includes a ripping structure having at least one ripper and an electrode. The apparatus generates electrical energy and discharges the electrical energy into the material through the ripping structure.

In another aspect of the present invention, an apparatus to assist an earthmoving vehicle in the fracture of material is provided. The apparatus includes a ripping structure having at least one ripper and an electrode. The apparatus heats the surface of the material and discharges electrical energy into the material through the ripping structure.

BEST MODE FOR CARRYING OUT THE INVENTION

Figure 1:
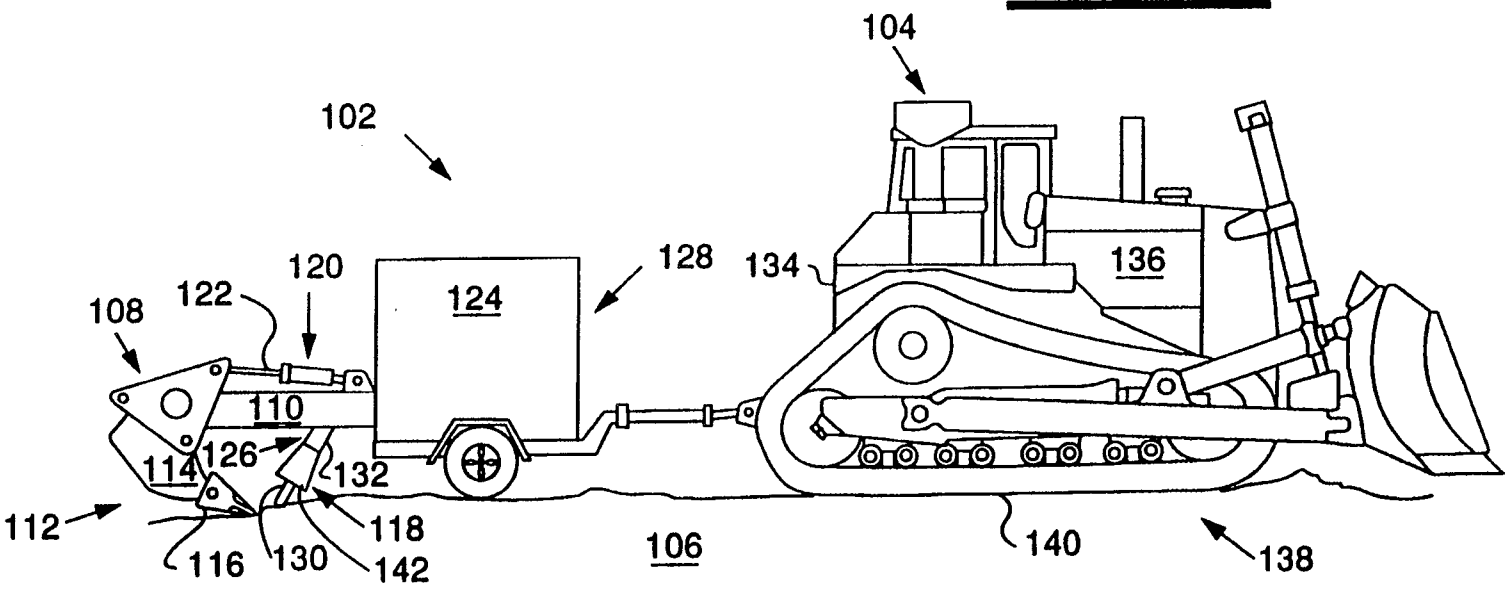
FIG. 1 is a stylized representation of an earthmoving vehicle, a trailer, and a ripping structure mounted to the trailer, according to an embodiment of the present invention.
Figure 2:
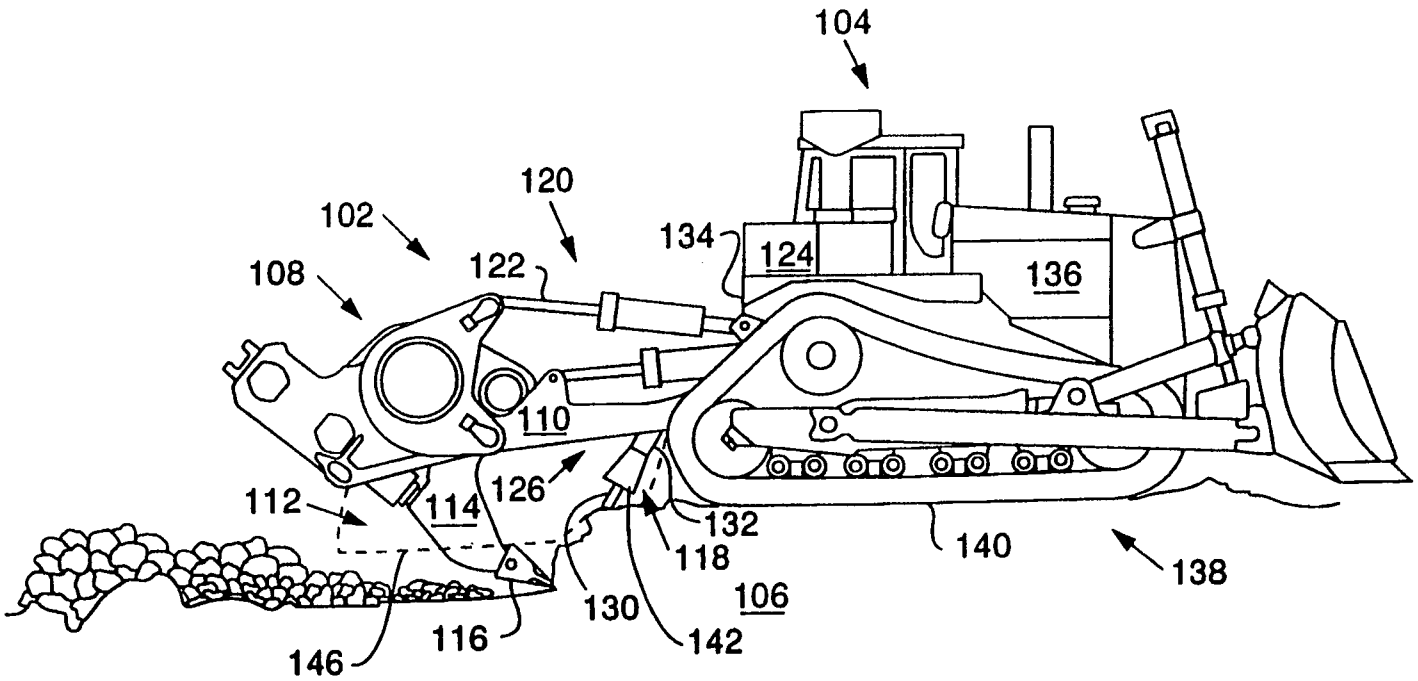
FIG. 2 is a stylized representation of an earthmoving vehicle and a ripping structure mounted to the vehicle, according to another embodiment of the present invention.

With reference to FIGS. 1 and 2, the present invention or high voltage ripping apparatus 102 is adapted to assist an earthmoving vehicle 104 in the fracture of material 106. In the preferred embodiment, the vehicle 104 is a track-type tractor (TTT). The TTT 104 includes a body 134 and an engine (denoted generally by reference numeral 136). The TTT 104 further includes a means 138 for moving the TTT 104 responsive to an operator. In the preferred embodiment, the moving means 138 includes a track 140.

The apparatus 102 includes a ripping structure 108. In one embodiment, the ripping structure 108 is mounted on a trailer 128 which is pulled by the TTT 104, as shown in FIG. 1. In another embodiment, the ripping structure 108 is mounted directly to the TTT 104, as shown in FIG. 2.

The ripping structure 108 includes a frame 110 and at least one ripper 112. Each ripper 112 has a shank 114 and a tip 116. The tip 116 of each ripper 112 is removable, so as to be replaced as wearing occurs. The ripping structure 108 is adapted to be pulled though material 106 by the TTT 104. In one embodiment, the ripper 112 is an impact ripper, as shown in FIG. 2. Rippers and impact rippers are well known in the art and are therefore, not further discussed.

An actuating means 120 moves the ripping apparatus 108 into a penetrating relationship with the material 106. The actuating means 120 includes at least one hydraulic cylinder 122,122' to move/rotate the rippers 112 into the material 106.

The ripping apparatus 108 further includes a contact 118. The contact 118 includes an electrode 130 and a shroud 132. The ripping apparatus 108 is adapted to move the contact 132 onto a contacting relationship with the material 106. In one embodiment, when actuated the contact 118 is spring biased into a contacting relationship with the material 106. In another embodiment, the contact 118 is hydraulically actuated.

A means 124 generates electrical energy and discharges the electrical energy into the material 106 through the ripping structure 108. In the preferred embodiment, the electrical energy is discharged into the material 106 in the form of high voltage pulses.

In the preferred embodiment, the electrical energy generating and dissipating means 124 is sealed in a container and surrounded by insulating oil.

A heating means 126 heats the surface of the material 106 in order to prevent surface arcing. In one embodiment, the heating means 126 pipes the engine's 136 exhaust gases to the ripping apparatus 108 and directs the gases to the surface of the material 108 via the shroud 132. In another embodiment, the heating means 128 guides a voltage insulating gas, for example, sulfur hexaflouride ($SF_6$) gas, flush around the electrode. The shroud 132 helps to briefly contain the gas. In a further embodiment, the shroud 132 or a separate shield 142 extends down to substantially the end of the electrode 130. In still another embodiment, a metal or other suitable material windscreen 146 may be used to help contain the gas, as shown in dotted lines in FIG. 2.

In another embodiment, as shown in FIG. 2B, the ripping structure includes a magnetic insulator 144 for guiding the electrical discharge into the material in order to prevent surface flashover. The magnetic insulator 144 is connected between the electrode 130 and a contacting electrode 130', as shown. In the preferred embodiment, the magnetic insulator 144 includes a low inductance single turn solenoid. The low inductance single turn solenoid generates a strong magnetic flux density, typically in the range of 10–20 tesla.

Figure 3A:
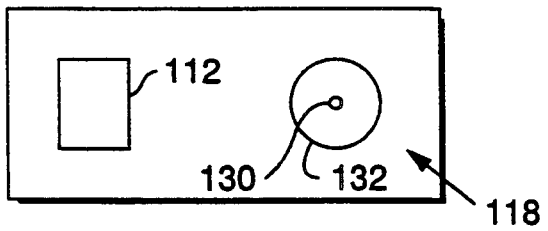
FIG. 3A is a stylized representation of a top view of a single ripper and electrode arrangement, according to an embodiment of the present invention.

With reference to FIG. 3A, in one embodiment, the ripping structure 108 includes a single ripper 112 and a single contact 118. The generator means 124 discharges the electrical energy into the material 106 through the ripper 114 and the contact 118.

Figure 3B:
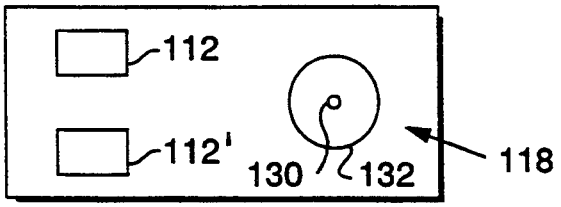
FIG. 3B is a stylized representation of a top view of a dual ripper and single electrode arrangement, according to an embodiment of the present invention.

With reference to FIG. 3B, in another embodiment, the ripping structure 108 includes first and second rippers 112,112' and a single contact 118. The generating means 124 alternately discharges the electrical energy into the material 106 using each ripper 114 and the contact 118.

Figure 3C:
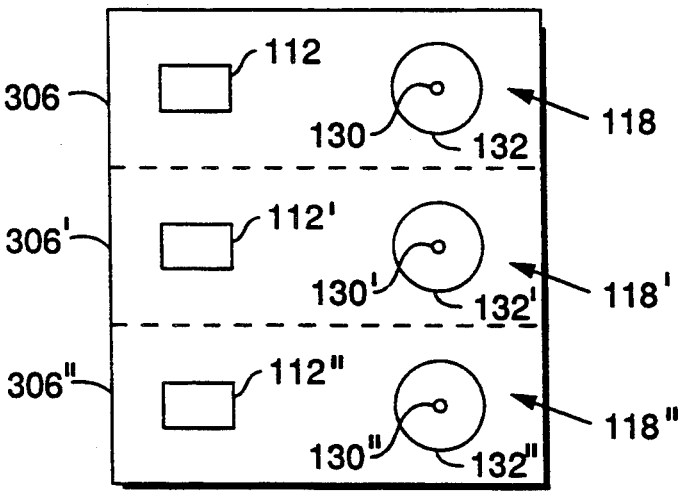
FIG. 3C is a stylized representation of a top view of a modular ripper and electrode arrangement, according to an embodiment of the present invention.

With reference to FIG. 3C, in still another embodiment, the ripping structure 108 includes a plurality of modules 302,302',302''. Each module 302,302',302'' includes a single ripper 114 and a single contact 118. The generating means 124 may alternately discharge electrical energy into the material 106 through each module 302,302',302''.

Figure 4:
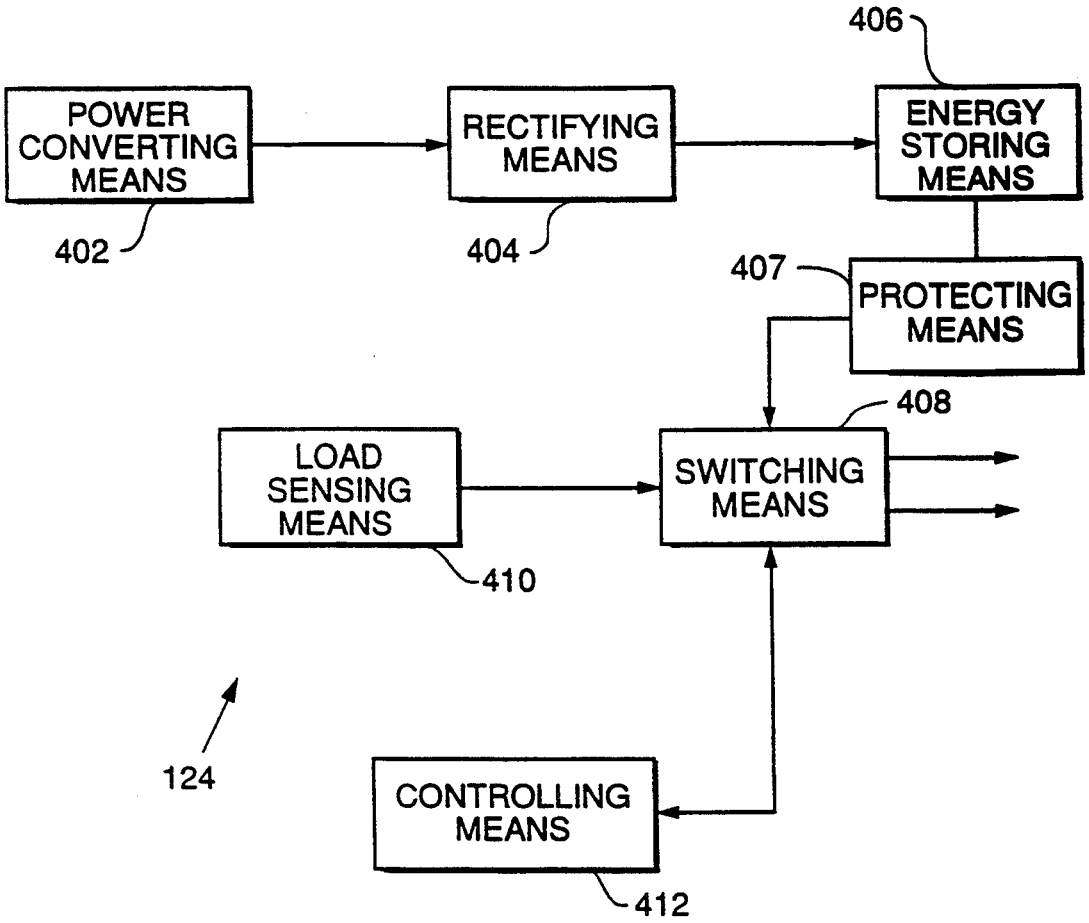
FIG. 4 is a block diagram of the electrical generating means having a power converting means, a rectifying means, an energy storing means, a protecting means, a switching means, and a controlling means, according to an embodiment of the present invention.
Figure 2A:
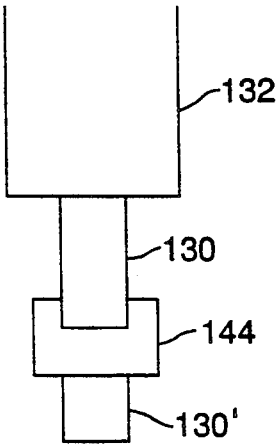
FIG. 2A is a stylized representation of the electrode of the ripping structure of FIGS. 1 and 2 having magnetic insulation, according to an embodiment of the present invention.

With reference to FIG. 4, the electrical energy generating means 124 includes a power converting means 402. In the preferred embodiment, the power converting means 402 converts the mechanical energy output of the engine of the TTT 104 into alternating current (AC). In the preferred embodiment, the power converting means 402 includes an electrical generator (not shown) and a transformer. The use of an electrical generator to convert mechanical energy into electrical energy is well known in the art and is therefore not further discussed.

A rectifying means 404 converts the alternating current output of the power converting means 402 into direct current (DC).

Figure 5:
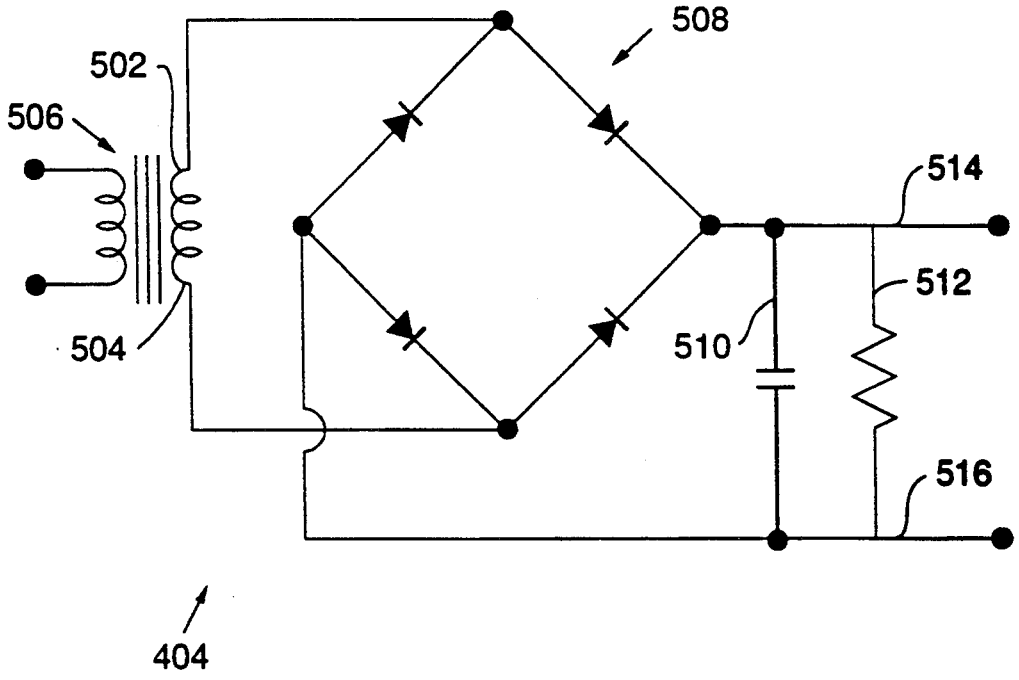
FIG. 5 is an electrical schematic of the rectifying means of FIG. 4.

With reference to FIG. 5, the rectifying means 404 has first and second input terminals 502,504 for receiving the alternating current output of the power converting means 402. The high voltage transformer 506 of the power converting means 402 is connected to the first and second input terminals 502,504. The output of the high voltage transformer 506 is connected to one side of a bridge rectifier 508. The other side of the bridge rectifier 508 is connected to a first capacitor 510 and a first resistor 512 connected in parallel. First and second output terminals 514,516 are connected across the first capacitor and resistor 510,512.

Referring again to FIG. 4, a means 406 receives electrical energy from the rectifying means 404 in the form of direct current (DC) and stores the electrical energy. In the preferred embodiment, the energy storing means 406 includes a pulse generator which is of the Marx generator type.

Figure 6A:
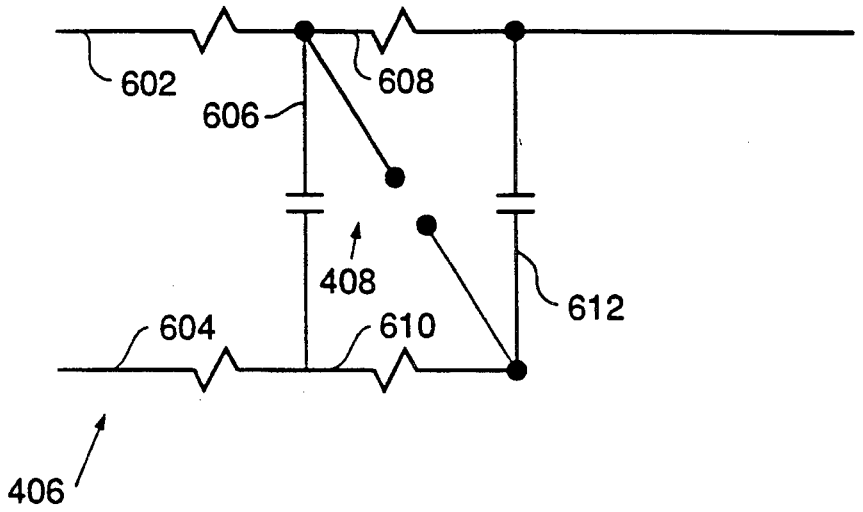
FIG. 6A is an electrical schematic of the energy storing means of FIG. 4.

With reference to FIG. 6A, the energy storing means 406 includes second and third resistors 602,604 connected to the first and second output terminals 514,516, respectively. A second capacitor 606 is connected between the junction of the second resistor 602 and a fourth resistor 608 and the junction between the third resistor 604 and a fifth resistor 610. A third capacitor 612 connects the fourth and fifth resistors 608,610.

Figure 6B:
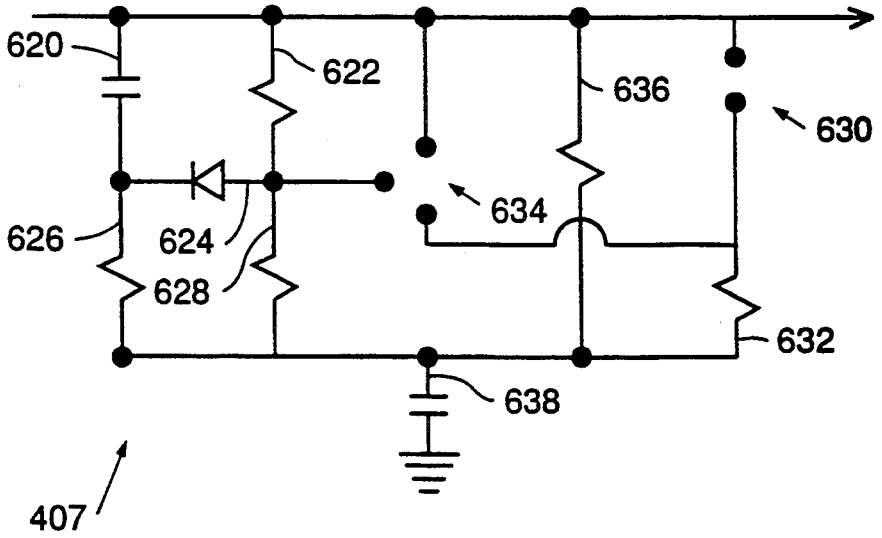
FIG. 6B is an electrical schematic of the protecting means of FIG. 4.

A means 407 protects the energy storing means 406 from reflected energy. With reference to FIG. 6B, the protecting means 408 includes a fourth capacitor 620 connected to the output of the energy storing means 406. A sixth resistor 622 is connected to the fourth capacitor at one end and through a first diode 624. Seventh and eighth resistors 626,628 connect the cathode and anode of the first diode 624, respectively, to a fifth capacitor 638. A kickback switch 630 has one terminal connected to the fourth capacitor 420 and another end connected to the fifth capacitor 636 through a ninth resistor 632. A shutoff triode 634 a first terminal connected to the fourth capacitor 620, a second terminal connected to the juncture between the sixth and eighth resistors 622,628, and a third terminal connected to the juncture between the kickback switch 630 and the ninth resistor 632. A tenth resistor 636 connects one of end of the fourth capacitor 620 to the fifth capacitor 638.

When the magnitude of the reflected energy reaches a threshold, the kickback switch turns on and routes the reflected energy to an "internal dump", the fifth capacitor 638 for later retrieval. The shutoff triode 634 cuts off the output pulse (to the ripper) after the peak output voltage has been reached to minimize the reflected energy and to route the excess energy to the fifth capacitor 638.

A switching means 408 is connected across the junction between the second capacitor 606 and the fourth resistor 608 and the junction between the third capacitor 612 and the fifth resistor 610. The ripping structure 108 is connected to the energy storing means 406 at the junction between the fourth resistor 608 and the third capacitor 612.

Figure 7:
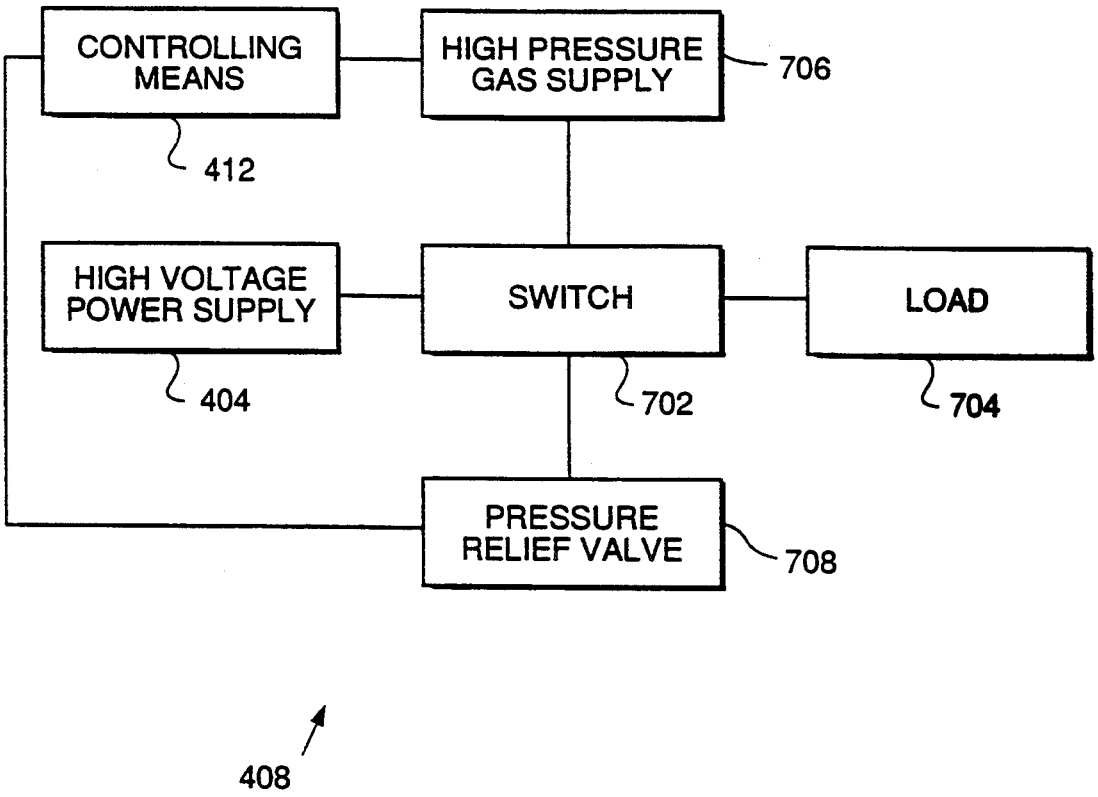
FIG. 7 is a block diagram of the switching means of FIG. 4.

Referring again to FIG. 4, the switching means 408 receives electrical energy from the energy storing means 406 and controllably discharges the electrical energy into the material through the rippers. In the preferred embodiment, the switching means 408 includes a spark gap switch 702 and a pressure release valve 708, as shown in FIG. 7.

A means 410 senses the load on the ripping structure 108 and produces a signal indicative of the sensed load.

In the preferred embodiment, the load sensing means 410 includes a pressure sensor.

A means 412 receives the local signal from the load sensing means 410 and controllably actuates the switching means 408.

In the preferred embodiment, the controlling means 412 is microprocessor based and controllably actuates the switching means 408 as a function of the sensed load.

In the preferred embodiment, the energy discharged into the material through the ripping structure is in the form of high voltage pulses.

In one embodiment, the controlling means 412 varies the magnitude of the electrical energy dissipated into the material as a function of the load signal. The magnitude of the electrical energy may be varied by increasing and decreasing the duty cycle of the high voltage pulses. This may be done by changing the pulse duration or by changing the period of the pulses.

In another embodiment, the controlling means 412 alternates the polarity of the pulses. That is, during one pulse, current flows from the electrode 130 to the ripper 114 and during the subsequent pulse, current flows from the ripper 114 to the electrode 130.

Typically, the high voltage pulses have a magnitude in the range of 0.1 to 1 megavolts (MV). In the preferred embodiment, the high voltage pulses have a magnitude of 250 kV.

Typically, the high voltage pulses have durations in the range of 0.01 to 100 microseconds. In the preferred embodiment, the high voltage pulses have durations in the 1 microsecond range.

With reference to FIG. 7, the switching means 408 includes a switching element or switch 702. In the preferred embodiment, the switch 702 is a spark gap switch which is actuated by increasing and decreasing the pressure of the gas within the switch 702 between an open value and a closed value. The gas acts as an insulator under the open value and as a short circuit under the closed value. It should be recognized that other types of switches could be utilized and the present invention is therefore not limited to any specific switch.

Figure 8:
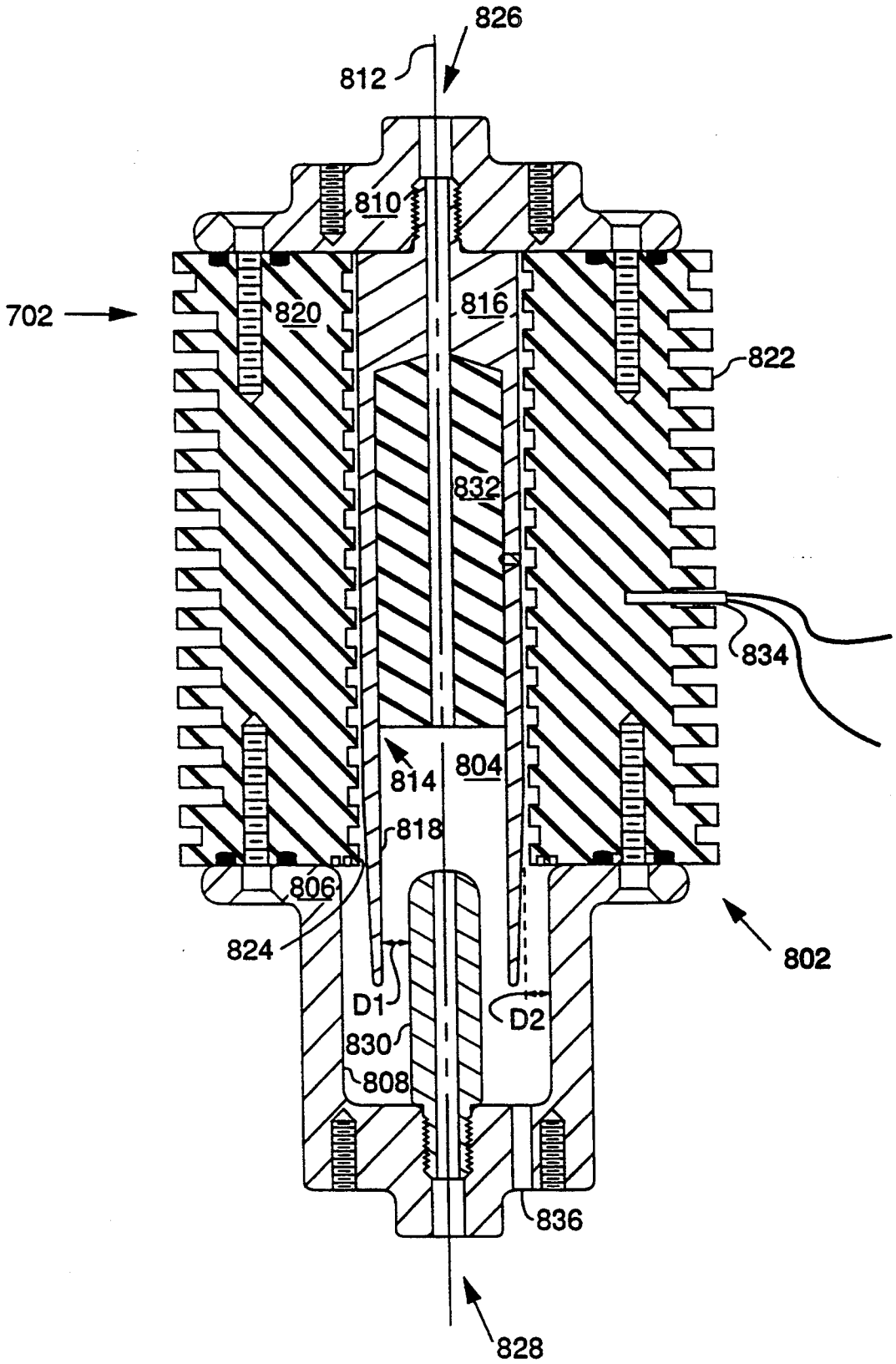
FIG. 8 is a stylized representation of the switch of FIG. 7.

With reference to FIG. 8, the switch 702 includes a housing 802. In the preferred embodiment the housing 802 includes a body 820 and first and second end portions or endcaps 806,810. The housing 802 has a generally circular cross-section centered about an axis 812. The body 820 and first and second endcaps 806,810 form a pressurized cavity 804. The first and second endcaps 806,810 are composed of an electrically conducting material, preferably a copper alloy.

The body 820 is composed of an insulating material. In the preferred embodiment, the body 820 is composed of a polycarbonate. The body 8200 has an exterior surface or wall 822 which is, preferably, grooved. The body 820 has an interior surface or wall 824 which is also, preferably, grooved.

In the preferred embodiment, the first endcap 806 forms a first electrode. However, the present invention is not limited to such and the first endcap and the first electrode may be separate.

The first electrode 806 has an inner surface 808. The inner surface 808 has a generally circular cross-section perpendicular to the axis 812. The inner surface 808 extends along the cavity 804 in a first direction along the axis 812, forming a hollow tube.

A second electrode 814 has first and second ends 816,818 and in the preferred embodiment is connected to the second endcap 810 at the first end 816. The second end 818 of the second electrode 814 has a generally circular cross-section perpendicular to the axis 812. The second end 818 of the second electrode 814 extends into the cavity 804 in a second direction along the axis 812. Preferably, the first and second directions are opposite. In the preferred embodiment, the second end 818 of the second electrode 814 extends at least partially into the hollow tube formed by the first electrode 802.

In one embodiment, the first and second electrodes are composed of copper. In another embodiment, the second electrode 814 includes a tip portion. The tip portion is preferably composed of tungsten or a tungsten alloy. A suitable alloy is available under the trade name Elkonite which consists of tungsten and copper.

In the preferred embodiment, the second electrode 814 is tapered. That is, the thickness of the second end portion 818 of the second electrode 814 decreases toward the end, thereby, increasing the distance between the first and second electrodes 806,814.

The operating characteristics of the switch 800 may be modified by varying the distance between the first and second electrodes 806,814. In the preferred embodiment, this is accomplished by changing the outside diameter of the second electrode 814.

In the preferred embodiment, the switch 702, includes a third electrode 830. The third electrode 830 is electrically connected to the first electrode 806. The third electrode 830 has a generally circular cross-section perpendicular to the axis 812 and extends along the axis 812 in the first direction.

In the preferred embodiment, the second electrode 884 forms a second hollow tube. The third electrode 830 extends into the second hollow tube formed by the second electrode 884. The distance between the second and third electrodes 814,830 (D1) is preferably greater than the distance between the first and second electrodes 806,814 (D2).

The switch 702 may include an insulating insert 832 situated in the hollow tube formed by the second electrode 814. The insulating tube 832 adds stability and also forms a part of a gas inlet port 826.

A fiber optic probe 834 senses the visible light emitted when the switch is firing. As shown, the probe 834, need only penetrate approximately halfway into the body 820 because Lexan allows a portion of the ultraviolet light to pass.

The housing 802 is held together by a plurality of screws. In the preferred embodiment, the screws are composed of nylon. Sealing gaskets or O-rings seal the juncture between the endcaps 806,810 and the body 820.

A window 836 provides optional ultraviolet triggering to fire the switch 702.

Referring again to FIG. 7, the switch 702 is opened and closed to supply electrical power to a load 704 (the ripping structure 108 and the Marx generator). In the preferred embodiment, the load 302 is connected to the first electrode 806. The second electrode 814 is electrically connected to a high voltage power supply (the rectifying means 404).

A high pressure gas supply 706 is provided for pressurizing the cavity 804. In the preferred embodiment the cavity 804 is pressurized with sulfur hexaflouride gas, $SF_6$.

A pressure release valve 708 releases the pressure from the cavity 804.

In the preferred embodiment, the cavity 804 is pressurized and unpressurized by actuation of the high pressure gas supply and pressure release valve 706,708 through the gas inlet port 826 and a gas outlet port 828, respectively, by the controlling means 412.

Figure 9:
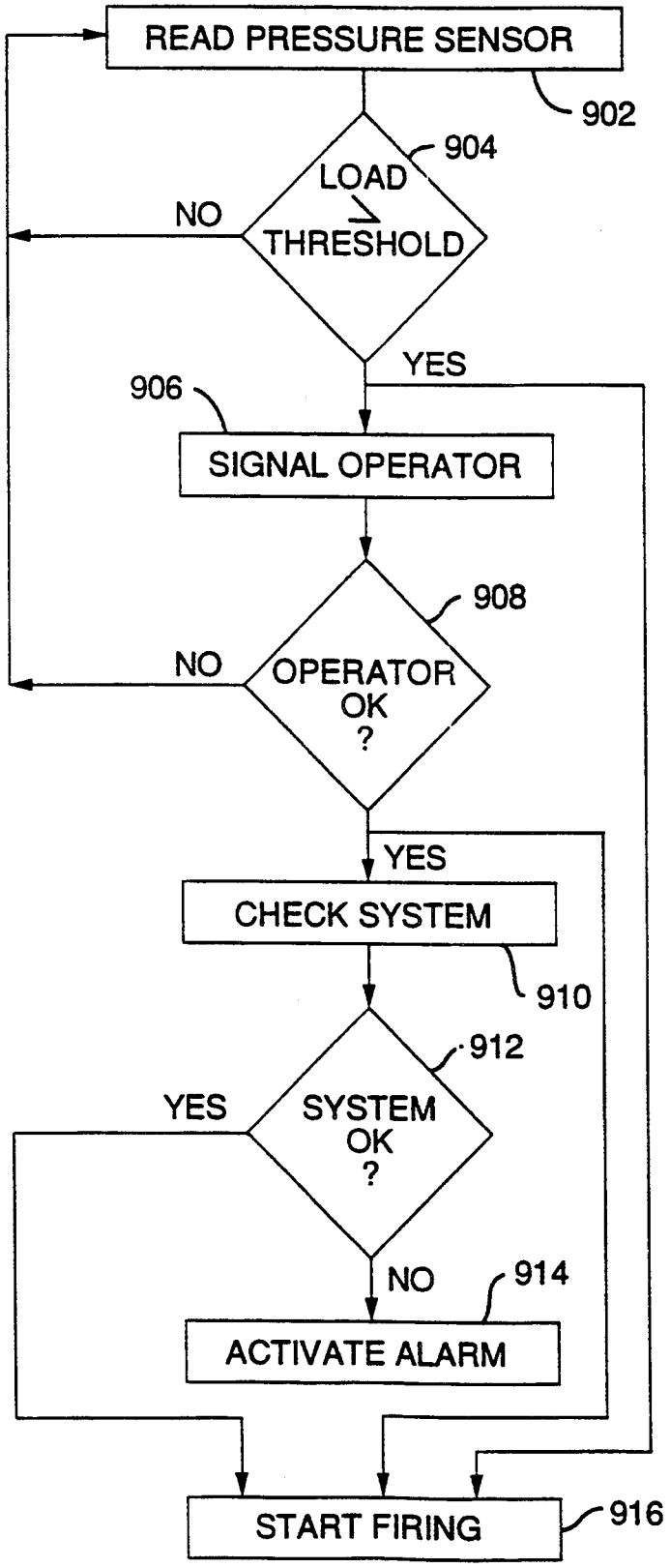
FIG. 9 is a logic diagram of the controlling means of FIG. 4.

With reference to FIG. 9, in order for the apparatus 102 to discharge energy into the material, three conditions must exist, First, the load on the ripping structure 108 must be greater than a predetermined threshold. In a first control block 902, the load is read from the pressure sensor 410. In a second control block 904, the pressure reading is compared to the threshold. If the threshold is less than the threshold, control returns to the first control block 902. Otherwise, in a third control block 906, the operator is signalled. In order for the apparatus 102 to begin, the operator must enable the apparatus 102. Typically this would be done through a switch (not shown). If the operator enables the apparatus 102 (fourth control block 908), control proceeds to a fifth control block 910. In the fifth control block 910, the apparatus 102 performs a self-diagnostic routine. The diagnostic routine checks the availability and pressure of insulating gas, the insulating oil level, the pressure within the switch 800, and other portions of the electrical energy generating and discharging means. If the apparatus 102 is not OK, the operator is signalled of an error (sixth control block 916). If the apparatus 102 is OK, then control proceeds to a seventh control block 916. If all three condition exist, then the apparatus 102 proceeds to assist the ripping structure 108 in fracturing the material by discharging electrical energy into the material.

INDUSTRIAL APPLICABILITY

With reference to the drawings and in operation, the present invention 102 is adapted to assist a TTT 104 in the fracture of material in a mining environment.

With a conventional tractor/ripper arrangement, the operator will make at least two passes with the vehicle over the same ground area. During the first pass, the operator will engage the ripping apparatus. This is normally accomplished through actuation of a control layer within the operator's cab. As the ripper is pulled through the material, the material is fractured or broken up. This is an inefficient process, as most of the work is being done through the tip 116 of the ripper 114. Consequently, the tip wears out at a fast rate and has to be replaced often.

In order to assist the ripping process, the present invention 102 is adapted to generate and dissipate electrical energy into the material when the ripper 114 is actuated. In the preferred embodiment, the amount of energy dissipated into the material 106 is a function of the material 106, that is, the amount of work needed to fracture the material. For example, when the ripper is engaged, if the material is fractured easily enough by the ripper alone, no assistance is needed. As the ripper 114 engages harder material 106, the energy generating and dissipating means discharges energy into the material 106. The load sensing means 410 senses the hardness of the material 106 by sensing the pressure the material 106 is putting on the ripper 114. As the hardness of the material 106 increases or decreases, the energy dissipated into the material 106 increases and decreases, respectively.

Other aspects, object, and features of the present invention can be obtained from a study of the drawings, the disclosure, and the appended claims.

We claim:

1. An apparatus (102) to assist an earthmoving vehicle (104) in the fracture of material (106), comprising:

a ripping structure (108) having a frame (110), at least one ripper (112), and an electrode (118), said at least one ripper (112) and said electrode (118) being movably connected to said frame (110);

means (120) for moving said at least one ripper (112) into a penetrating relationship with said material (106) and for moving said electrode (130) into a contacting relationship with said material (106); and means (124) for generating electrical energy and discharging said electrical energy into said material (106) through said at least one ripper (112) and said electrode (130).

2. An apparatus (102), as set forth in claim 1, wherein said electrical energy is in the form of high voltage pulses.

3. An apparatus (102), as set forth in claim 2, wherein said high voltage pulses have a magnitude in the range of 0.1 to 1 MV.

4. An apparatus (102), as set forth in claim 2, wherein said high voltage pulses have a magnitude of approximately 0.25 MV.

5. An apparatus (102), as set forth in claim 2, wherein said high voltage pulses have a duration in the range of 0.01 to 100 microseconds.

6. An apparatus (102), as set forth in claim 2, wherein said high voltage pulse have a duration of approximately 1 microsecond.

7. An apparatus (102), as set forth in claim 1, wherein said ripping structure (108) includes a second ripper (112').

8. An apparatus (102), as set forth in claim 1, wherein said ripping structure (108) includes at least two modules (306,306'), each module (306,306') including a ripper (112) and an electrode (130).

9. An apparatus (102), as set forth in claim 1, includes means (126) for heating said material (106).

10. An apparatus (102), as set forth in claim 1, including means (402) for converting the mechanical energy of said vehicle's (104) engine into electrical energy.

11. An apparatus to assist an earthmoving vehicle in the fracture of material, comprising:

a ripping structure having a frame, at least one ripper, and an electrode, said at least one ripper and said electrode being movably connected to said frame;

means for moving said at least one ripper into a penetrating relationship with said material and for moving said electrode into a contacting relationship with said material; and, means for generating electrical energy and discharging said electrical energy into said material through said at least one ripper and said electrode, wherein said at least one ripper is an impact ripper.

12. An apparatus to assist an earthmoving vehicle in the fracture of material, comprising:

a ripping structure having a frame, at least one ripper, and an electrode, said at least one ripper and said electrode being movably connected to said frame;

means for moving said at least one ripper into a penetrating relationship with said material and for moving said electrode into a contacting relationship with said material;

means for generating electrical energy and discharging said electrical energy into said material through said at least one ripper and said electrode; and means for sensing the load on said ripping structure and responsively producing a load signal and wherein said discharging means includes controlling means for receiving said load signal and responsively varying the magnitude of electrical energy discharged into said material.

13. An apparatus (102), as set forth in claim 12, wherein said sensing means (410) includes a pressure sensor.

14. An apparatus, as set forth in claim 12, wherein said electrical energy is in the form of high voltage pulses and wherein said controlling means varies the magnitude of said electrical energy by increasing and decreasing a duty cycle of said high voltage pulses.

15. An apparatus, as set forth in claim 14, wherein said controlling means increases and decreases a duty cycle of said high voltage pulses by varying the pulse duration.

16. An apparatus, as set forth in claim 14, wherein said controlling means increases and decreases a duty cycle of said high voltage pulses by varying the pulse period.

17. An apparatus to assist an earthmoving vehicle in the fracture of material, comprising:

a ripping structure having a frame, at least one ripper, and an electrode, said at least one ripper and said electrode being movably connected to said frame;

means for moving said at least one ripper into a penetrating relationship with said material and for moving said electrode into a contacting relationship with said material; and means for generating electrical energy and discharging said electrical energy into said material through said at least one ripper and said electrode, wherein said electrical energy is in the form of high voltage pulses and wherein said discharging means alternates the polarity of said high voltage pulses.

18. An apparatus to assist an earthmoving vehicle in the fracture of material, comprising:

a ripping structure having a frame, at least one ripper, and an electrode, said at least one ripper and said electrode being movably connected to said frame;

means for moving said at least one ripper into a penetrating relationship with said material and for moving said electrode into a contacting relationship with said material;

means for generating electrical energy and discharging said electrical energy into said material through said at least one ripper and said electrode, wherein said ripping structure includes a second ripper and wherein said discharging means alternately discharges electrical energy into said material through said first ripper and said electrode and through said second ripper and said electrode.

19. An apparatus to assist an earthmoving vehicle in the fracture of material, comprising:

a ripping structure having a frame, at least one ripper, and an electrode, said at least one ripper and said electrode being movably connected to said frame;

means for moving said at least one ripper into a penetrating relationship with said material and for moving said electrode into a contacting relationship with said material; and means for generating electrical energy and discharging said electrical energy into said material through said at least one ripper and said electrode, wherein said ripping structure includes at least two modules, each module including a ripper and an electrode and wherein said discharging means includes controlling means for alternately discharging said electrical energy into said material through each of said modules.

20. An apparatus to assist an earthmoving vehicle in the fracture of material, comprising:

a ripping structure having a frame, at least one ripper, and an electrode, said at least one ripper and said electrode being movably connected to said frame;

means for moving said at least one ripper into a penetrating relationship with said material and for moving said electrode into a contacting relationship with said material; and means for generating electrical energy and discharging said electrical energy into said material through said at least one ripper and said electrode; and means for heating said material, wherein said heating means includes means for directing an insulating gas at said material.

21. An apparatus (102), as set forth in claim 20, wherein said insulating gas is sulfur hexaflouride gas.

22. An apparatus to assist an earthmoving vehicle in the fracture of material, comprising:

a ripping structure having a frame, at least one ripper, and an electrode, said at least one ripper and said electrode being movably connected to said frame;

means for moving said at least one ripper into a penetrating relationship with said material and for moving said electrode into a contacting relationship with said material;

means for generating electrical energy and discharging said electrical energy into said material through said at least one ripper and said electrode; and means for heating said material, wherein said heating means includes means for directing the exhaust gases of said earthmoving vehicle's engine towards said material.

23. An apparatus to assist an earthmoving vehicle in the fracture of material, comprising:

a ripping structure having a frame, at least one ripper, and an electrode, said at least one ripper and said electrode being movably connected to said frame;

means for moving said at least one ripper into a penetrating relationship with said material and for moving said electrode into a contacting relationship with said material; and means for generating electrical energy and discharging said electrical energy into said material through said at least one ripper and said electrode, wherein said electrical energy discharging means includes a magnetic insulator adapted to guide the electrical discharge into said material.

24. An apparatus to assist an earthmoving vehicle in the fracture of material, comprising:

a ripping structure having a frame, at least one ripper, and an electrode, said at least one ripper and said electrode being movably connected to said frame;

means for moving said at least one ripper into a penetrating relationship with said material and for moving said electrode into a contacting relationship with said material;

means for generating electrical energy and discharging said electrical energy into said material through said at least one ripper and said electrode, means for converting the mechanical energy of said vehicle's engine into electrical energy; and means for storing said converted electrical energy.

25. An apparatus (102), as set forth in claim 24, including means (408) for controllably switching said storing means (406) into and out of contact with said ripping structure (108).

26. An apparatus to assist an earthmoving vehicle in the fracture of material, said earthmoving vehicle having an engine, comprising:

a ripping structure having a frame, at least one ripper, and an electrode, said ripping structure being movably connected to said earthmoving vehicle, said ripper and said electrode being pivotally connected to said frame;

means for heating the surface of said material;

means for moving said ripping structure into a penetrating relationship with said material; and means for generating electrical energy and discharging said electrical energy into said material through said ripping structure.

27. An apparatus (102), as set forth in claim 26, wherein said electrical energy is in the form of high voltage pulses.

28. An apparatus (102), as set forth in claim 27, wherein said high voltage pulses have a magnitude in the range of 10 kV to 1 MV.

29. An apparatus (102), as set forth in claim 27, wherein said high voltage pulses have a magnitude of approximately 250 kV.

30. An apparatus (102), as set forth in claim 27, wherein said high voltage pulses have a duration in the range of 0.01 to 100 microseconds.

31. An apparatus (102), as set forth in claim 27, wherein said high voltage pulse have a duration of approximately 1 microsecond.

32. An apparatus (102), as set forth in claim 26, wherein said ripping structure (108) includes a second ripper (112').

33. An apparatus to assist an earthmoving vehicle in the fracture of material, said earthmoving vehicle having an engine, comprising:

a ripping structure having a frame, at least one ripper and an electrode, said ripping structure being movably connected to said earthmoving vehicle, said ripper and said electrode being pivotally connected to said frame;

means for heating the surface of said material;

means for moving said ripping structure into a penetrating relationship with said material; and means for generating electrical energy and discharging said electrical energy into said material through said ripping structure, wherein said electrical energy discharging means includes a magnetic insulator adapted to guide the electrical discharge into said material.

34. An apparatus to assist an earthmoving vehicle in the fracture of material, said earthmoving vehicle having an engine, comprising:

a ripping structure having a frame, at least one ripper and an electrode, said ripping structure being movably connected to said earthmoving vehicle, said ripper and said electrode being pivotally connected to said frame;

means for heating the surface of said material;

means for moving said ripping structure into a penetrating relationship with said material; and means for generating electrical energy and discharging said electrical energy into said material through said ripping structure, wherein said electrical energy is in the form of high voltage pulse and wherein said discharging means includes means for alternating the polarity of said high voltage pulses.

35. An apparatus to assist an earthmoving vehicle in the fracture of material, said earthmoving vehicle having an engine, comprising:

a ripping structure having a frame, at least one ripper and an electrode, said ripping structure being movably connected to said earthmoving vehicle, said ripper and said electrode being pivotally connected to said frame;

means for heating the surface of said material;

means for moving said ripping structure into a penetrating relationship with said material;

means for generating electrical energy and discharging said electrical energy into said material through said ripping structure; and means for sensing the load on said ripping structure and responsively producing a load signal and wherein said discharging means includes controlling means for receiving said load signal and responsively varying the magnitude of electrical energy discharged into said material.

36. An apparatus, as set forth in claim 35, wherein said electrical energy is in the form of high voltage pulses and wherein said controlling means varies the magnitude of said electrical energy by increasing and decreasing a duty cycle of said high voltage pulses.

37. An apparatus, as set forth in claim 36, wherein said controlling means increases and decreases a duty cycle of said high voltage pulses by varying the pulse duration.

38. An apparatus, as set forth in claim 36, wherein said controlling means increases and decreases a duty cycle of said high voltage pulses by varying the pulse period.

39. An earthmoving vehicle (104) adapted to fracture material (106), including:

a body (134) having an engine (136) and means (138) coupled to said engine (136) for moving said vehicle (104);

a ripping structure (108) having a frame (110), at least one ripper (112), and an electrode (118), said at least one ripper (112) and said electrode (118) being movably connected to said frame (110);

means (120) for moving said at least one ripper (112) into a penetrating relationship with said material (106) and for moving said electrode (130) into a contacting relationship with said material (106); and means (124) for generating electrical energy and discharging said electrical energy into said material (106) through said at least one ripper (112) and said electrode (130).

40. An earthmoving vehicle (104), as set forth in claim 39, wherein said electrical energy is in the form of high voltage pulses.

41. An earthmoving vehicle (104), as set forth in claim 40, wherein said high voltage pulses have a magnitude in the range of 10 kV to 1 MV.

42. An earthmoving vehicle (104), as set forth in claim 40, wherein said high voltage pulses have a magnitude of approximately 250 kV.

43. An earthmoving vehicle (104), as set forth in claim 40, wherein said high voltage pulses have a duration in the range of 0.01 to 100 microseconds.

44. An earthmoving vehicle (104), as set forth in claim 40, wherein said high voltage pulse have a duration of approximately 1 microsecond.

45. An earthmoving vehicle (104), as set forth in claim 39, wherein said ripping structure (108) includes a second ripper (112').

46. An earthmoving vehicle (104), as set forth in claim 39, including means (126) for heating the surface of said material (106).

47. An earthmoving vehicle adapted to fracture material, including:

a body having an engine and means coupled to said engine for moving said vehicle;

a ripping structure having a frame, at least one ripper, and an electrode, said at least one ripper and said electrode being movably connected to said frame;

means for moving said at least one ripper into a penetrating relationship with said material and for moving said electrode into a contacting relationship with said material; and means for generating electrical energy and discharging said electrical energy into said material through said at least one ripper and said electrode, wherein said electrical energy discharging means includes a magnetic insulator adapted to guide the electrical discharge into said material.

48. An earthmoving vehicle adapted to fracture material, including:

a body having an engine and means coupled to said engine for moving said vehicle;

a ripping structure having a frame, at least one ripper, and an electrode, said at least one ripper and said electrode being movably connected to said frame;

means for moving said at least one ripper into a penetrating relationship with said material and for moving said electrode into a contacting relationship with said material; and means for generating electrical energy and discharging said electrical energy into said material through said at least one ripper and said electrode, wherein said discharging means includes means for alternating the polarity of said high voltage pulses.

49. An earthmoving vehicle adapted to fracture material, including:

a body having an engine and means coupled to said engine for moving said vehicle;

a ripping structure having a frame, at least one ripper, and an electrode, said at least one ripper and said electrode being movably connected to said frame;

means for moving said at least one ripper into a penetrating relationship with said material and for moving said electrode into a contacting relationship with said material; and means for generating electrical energy and discharging said electrical energy into said material through said at least one ripper and said electrode; and means for sensing the load on said ripper structure responsively producing a load signal and wherein said discharging means includes means for receiving said load signal and responsively varying the magnitude of electrical energy discharged into said material.

50. An earthmoving vehicle, as set forth in claim 49, wherein said electrical energy is in the form of high voltage pulses and wherein said discharging means varies the magnitude of said electrical energy increasing and decreasing a duty cycle of said high voltage pulses.

51. An earthmoving vehicle, as set forth in claim 50, wherein said discharging means increases and decreases a duty cycle of said high voltage pulses by varying the pulse duration.

52. An earthmoving vehicle, as set forth in claim 50, wherein said discharging means increases and decreases a duty cycle of said high voltage pulses by varying the pulse period.

* * * * *